US010804614B2

(12) United States Patent
Wilde et al.

(10) Patent No.: US 10,804,614 B2
(45) Date of Patent: Oct. 13, 2020

(54) SPACE FRAME ANTENNA

(71) Applicant: AvL Technologies, Inc., Asheville, NC (US)

(72) Inventors: Mike Wilde, Arden, NC (US); Alan Eugene Ellis, Candler, NC (US)

(73) Assignee: AvL Technologies, Inc., Asheville, NC (US)

( * ) Notice: Subject to any disclaimer, the term of this patent is extended or adjusted under 35 U.S.C. 154(b) by 28 days.

(21) Appl. No.: 16/351,265

(22) Filed: Mar. 12, 2019

(65) Prior Publication Data

US 2019/0280392 A1 Sep. 12, 2019

Related U.S. Application Data

(60) Provisional application No. 62/641,586, filed on Mar. 12, 2018.

(51) Int. Cl.

| | |
|---|---|
| ***H01Q 15/16*** | (2006.01) |
| ***H01Q 3/08*** | (2006.01) |
| ***H01Q 1/12*** | (2006.01) |
| ***H01Q 15/20*** | (2006.01) |

(52) U.S. Cl.

CPC ..... *H01Q 15/162* (2013.01); *H01Q 1/125* (2013.01); *H01Q 1/1235* (2013.01); *H01Q 3/08* (2013.01); *H01Q 15/20* (2013.01)

(58) Field of Classification Search

CPC ..... H01Q 15/162; H01Q 1/288; H01Q 1/161; H01Q 15/16; H01Q 15/161; H01Q 15/20; G01S 1/104; H01L 31/052; H01L 31/042; H01L 31/0525; H01L 31/0422; H02S 40/00

USPC ..... 343/915, 912, 756, 837, 839, 840

See application file for complete search history.

(56) References Cited

U.S. PATENT DOCUMENTS

2012/0326921 A1* 12/2012 Geen ..... H01Q 15/162 342/352

* cited by examiner

*Primary Examiner* — Wei (Victor) Y Chan

(74) *Attorney, Agent, or Firm* — William G. Heedy; The Van Winkle Law Firm

(57) ABSTRACT

A lightweight and portable space frame antenna includes a first plurality of reflector panels and a second plurality of reflector panels each being sized and configured such that each one of said first plurality of reflector panels can be nested inside a corresponding one of said second plurality of reflector panels, thereby defining a nested pairing; a plurality of helical cam latching devices for joining together each of the first and second pluralities of reflector panels; a reflector hub consisting of two pieces, wherein the first and second pluralities of reflector panels are mounted on the reflector hub to form a parabolic reflector; a foldable positioner for supporting the parabolic reflector; a telescoping actuator that is structured and disposed for providing elevation adjustment and may be selectively disconnected from the parabolic reflector; and an elevation-azimuth bar that is structured and disposed for providing azimuth adjustment through a bearing-free azimuth rotation.

18 Claims, 8 Drawing Sheets

SPACE FRAME ANTENNA

RELATED APPLICATION

This application claims the benefit of U.S. Provisional Patent Application Ser. No. 62/641,586 filed on Mar. 12, 2018.

FIELD OF THE INVENTION

This invention relates to a space frame antenna and, more specifically, a 2.0M portable antenna with nesting panels and bearing-free azimuth adjustment.

BACKGROUND OF THE INVENTION

Space frame antennas are lightweight, portable and versatile for geostationary satellite acquisition and peaking required for a specific use. Typically, a space frame antenna has a dish-type reflector and a positioner that is steerable while supporting the reflector. Traditional designs in the 2.0M class antennas are bulky and cannot be packed very efficiently. In the satellite industry to date, the high packability of a 2.0M class of space frame antenna has been somewhat achieved utilizing an inflatable ball and a prime focus feed mounted on the exterior of the ball. While this inflatable approach is useful for its intended purpose, there still exists considerable drawbacks relating to the high-volume storage needs for transporting the antenna and associated parts.

There exists a need in the art for a space frame antenna including a highly packable parabolic reflector and a collapsible positioner that is both space efficient and weight efficient.

SUMMARY OF THE INVENTION

In accordance with one form of the present invention, there is provided a lightweight and portable space frame antenna, the antenna including a first plurality of reflector panels and a second plurality of reflector panels each being sized and configured such that each one of said first plurality of reflector panels can be nested inside a corresponding one of said second plurality of reflector panels, thereby defining a nested pairing of reflector panels; a plurality of helical cam latching devices each being structured and disposed for joining each of the first plurality of reflector panels and each of the second plurality of reflector panels; a reflector hub consisting of two semi-circle pieces, wherein the first plurality of reflector panels and the second plurality of reflector panels are mounted on the reflector hub to form a parabolic reflector; and a foldable positioner that is sized and configured for supporting the parabolic reflector and both elevation and azimuth adjustments; a telescoping actuator that is structured and disposed for providing elevation adjustment and may be selectively disconnected from the parabolic reflector; and an elevation-azimuth bar that is structured and disposed for providing azimuth adjustment through a bearing-free azimuth rotation.

In accordance with another form of the present invention, there is provided a lightweight and portable space frame antenna, the antenna including a first plurality of reflector panels and a second plurality of reflector panels each being sized and configured such that each one of said first plurality of reflector panels can be nested inside a corresponding one of said second plurality of reflector panels, thereby defining a nested pairing of reflector panels; a plurality of helical cam latching devices each being structured and disposed for joining each of the first plurality of reflector panels and each of the second plurality of reflector panels; a reflector hub consisting of two pieces, wherein the first plurality of reflector panels and the second plurality of reflector panels are mounted on the reflector hub in a bi-chordal and bi-radial (BCBR) configuration to form a parabolic reflector; and a foldable positioner that is sized and configured for supporting the parabolic reflector and both elevation and azimuth adjustments; a telescoping actuator that is structured and disposed for providing elevation adjustment and may be selectively disconnected from the parabolic reflector; and an elevation-azimuth bar that is structured and disposed for providing azimuth adjustment through a bearing-free azimuth rotation In accordance with another form of the present invention, there is provided a method for erecting a lightweight and portable space frame antenna including the steps of forming a reflector hub by joining two semi-circle pieces; mounting a first plurality of reflector panels and a second plurality of reflector panels in a bi-chordal and bi-radial (BCBR) configuration to form a parabolic reflector; each of the first plurality of reflector panels and the second plurality of reflector panels being sized and configured such that each one of said first plurality of reflector panels can be nested inside a corresponding one of said second plurality of reflector panels; and supporting the parabolic reflector by a foldable positioner, wherein a telescoping actuator and an elevation-azimuth bar are structured and disposed for providing elevation adjustment and bearing-free azimuth adjustment for geostationary satellite acquisition.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, a space frame antenna including a symmetric parabolic reflector with two different sized reflector panels which are joined in a bi-chordal and bi-radial (BCBR) configuration and a foldable positioner with fine azimuth adjustment is shown.

Figure 1:
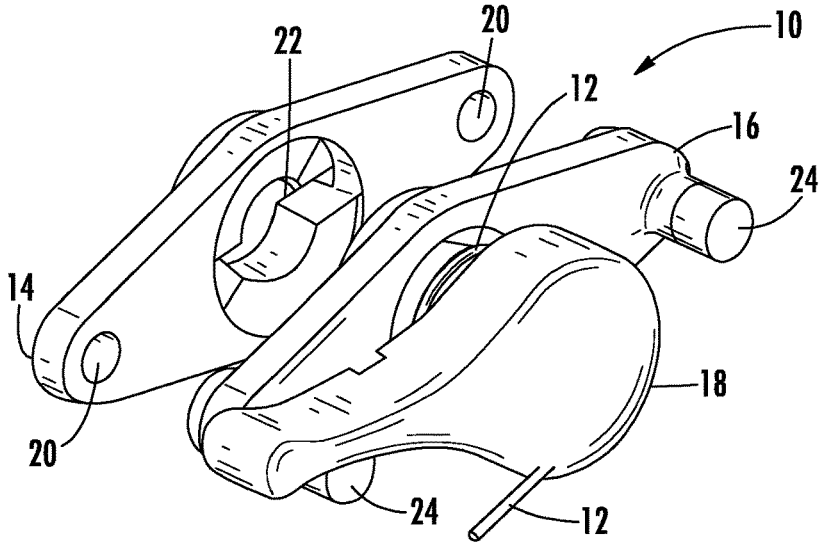
FIG. 1 is a perspective view of a machined aluminum version of a helical cam latching device.
Figure 2A:
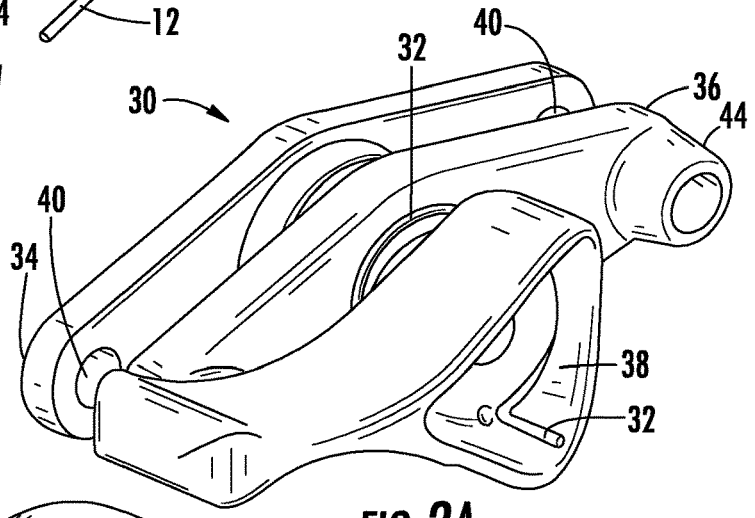
FIG. 2A is a front elevational of an injection molded embodiment of the helical cam latching device.
Figure 2B:
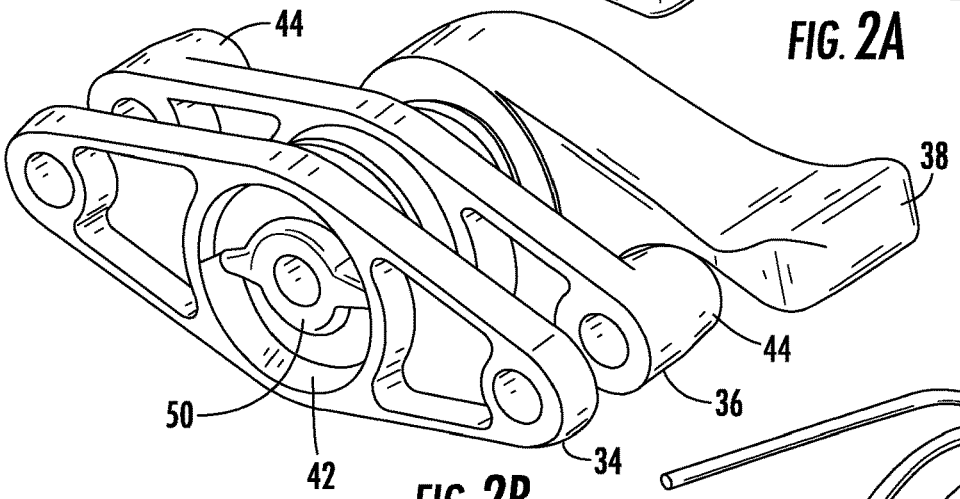
FIG. 2B is a perspective view of the injection molded embodiment of the helical cam latching device.
Figure 2C:
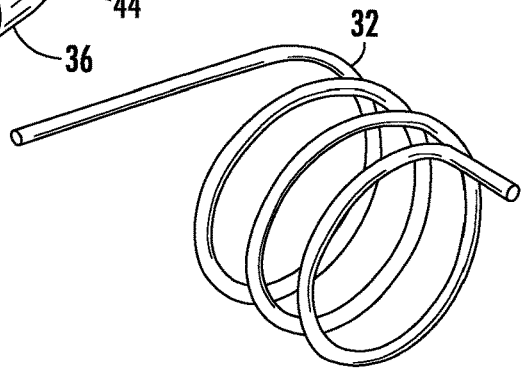
FIG. 2C is a perspective view of a loaded spring within the helical cam latching device in both axial and torsional directions.

Referring initially to FIGS. 1 and 2, a helical cam latching device 10 is shown. The helical cam latching device 10 may be formed using a variety of materials and methods. In one embodiment, the helical cam latching device 10 is a machined aluminum version. In the other embodiment, the helical cam latching device 10 is an injection molded version. The helical cam latching device 10 is structured and disposed for joining panels of a multi-panel parabolic reflector.

In accordance with one embodiment, and referring specifically to FIG. 1, the helical cam latching device 10 is formed from machined aluminum and includes a spring 12, a cam 14, a base 16, and a lever 18. The lever 18 serves as a handle for operation of the helical cam latching device 10. At opposing ends of the cam 14 there are two small through-holes 20. The base 16 includes rivets 24 at opposing ends of the base 16, each forming a positive stop for the spring-loaded lever 18 as it is actuated between the open and closed positions. The machined aluminum embodiment of the helical cam latching device 10 is a quarter turn latch such that the lever 18 can be selectively rotated back and forth ninety (90) degrees between the latched and unlatched positions. When the lever 18 is in the latched position, the spring 12 is loaded in both axial and torsional directions. The respective ranges of the axial and rotational motions are each restricted by the retainer (not shown) once it is riveted into the keyhole 22 on the cam 14. Further, the use of the spring 12 provides a zero-backlash connection that accommodates reflector panels of varying thicknesses.

Referring now to FIGS. 2A and 2B, another embodiment of the helical cam latching device 10 is formed from injection molding. The injection molding process more readily provides for an ergonomic design of the helical cam latching device 10, and includes a spring 32, a cam 34, a base 36, and a lever 38. The lever 38 serves as a handle for operation of the helical cam latching device 10. There is a through-hole 40 at opposing ends of the cam 34. Rivets 44 at opposing ends of the base 36, each extending towards the lever 38, each form a positive stop for the spring-loaded lever 38 as it is actuated between the open and closed positions. The injection molded version of the helical cam latching device 10 is also a quarter turn latch, such that the lever 38 can be selectively rotated back and forth ninety (90) degrees between the latched and unlatched positions. When the lever 38 is in the latched position, the spring 32 is loaded in both axial and torsional directions. The respective ranges of the axial and rotational motions are each restricted by the retainer 50 once it is riveted into the keyhole 42 of the cam 34. Also, the use of the spring 32 provides a zero-backlash connection that accommodates reflector panels of varying thicknesses. Still referring to FIG. 2B, the retainer 50 of the lever 38 is riveted in the keyhole 42 of the cam 34.

Figure 3A:
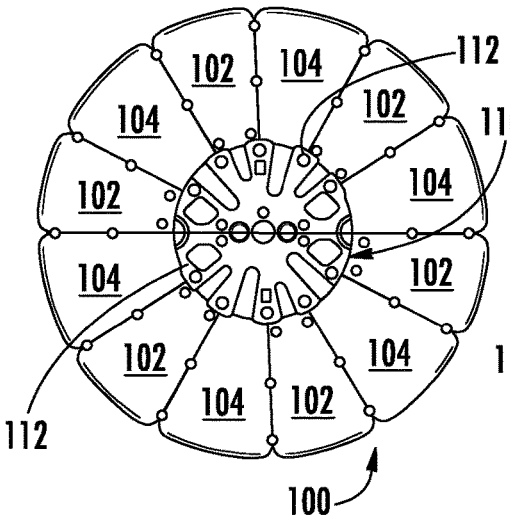
FIG. 3A is a rear elevational view of the symmetric parabolic reflector in a bi-chordal and bi-radial (BCBR) configuration.
Figure 3B:
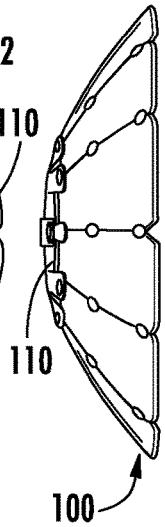
FIG. 3B is a side elevational view of the symmetric parabolic reflector in a bi-chordal and bi-radial (BCBR) configuration.
Figure 3C:
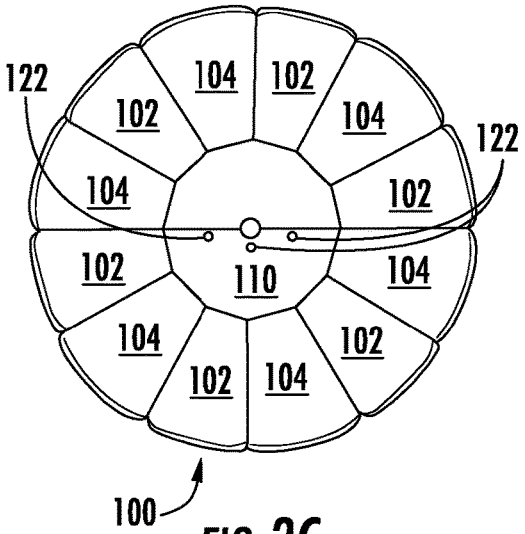
FIG. 3C is a front elevational view of a symmetric parabolic reflector in a bi-chordal and bi-radial (BCBR) configuration.

FIGS. 3A-3C illustrates a symmetric parabolic reflector 100 in a bi-chordal and bi-radial (BCBR) configuration, including a plurality of each of 28-degree and 32-degree panels 102 and 104. In one embodiment, the symmetric parabolic reflector 100 includes six (6) 28-degree reflector panels 102 and six (6) 32-degree reflector panels 104. As indicated, the central angle of the arc of each 28-degree reflector panel 102 is 28°, while the central angle of the arc of each 32-degree reflector panel 104 is 32°. The 28-degree reflector panels 102 and 32-degree reflector panels 104 are joined together in an alternating arrangement to form the symmetric parabolic reflector 100 and each reflector panel is mounted on a reflector hub 110 which resides internal of the symmetric parabolic reflector 100.

Referring to FIG. 3A, the front elevational view shows the geometry of the reflector hub 110 and the symmetric parabolic reflector 100 are two concentric circles. The reflector hub 110 is made of two semi-circle pieces 112 associated with each other. The assembled symmetric parabolic reflector 100 includes the reflector panels, i.e. the 28-degree reflector panels 102 and 32-degree reflector panels 104, secured to the perimeter of the reflector hub 110. The connection between one 28-degree reflector panel 102 and one 32-degree reflector panel 104 is secured by two helical cam latching devices 10. Each reflector panel 102 and 104 is mounted on the reflector hub 110 via two helical cam latching devices 10. The difference in the central angels of the 28-degree reflector panels 102 and 32-degree reflector panels 104 is featured as bi-chordal.

Referring to FIG. 3B, the assembled symmetric parabolic reflector 100 is shown mounted on the reflector hub 110. Referring to FIG. 3C, the length in the radial direction of the 28-degree reflector panel 102 is 28 inches, while the length in the radial direction of the 32-degree reflector panel 104 is 29 inches. The difference in the radial lengths of the reflector panels, i.e. the 28-degree reflector panels 102 and the 32-degree reflector panels 104, is featured as bi-radial. This bi-chordal and bi-radial (BCBR) configuration of the symmetric parabolic reflector 100 provides sufficient room for the helical cam latching devices 10 to join the 28-degree reflector panels 102 and the 32-degree reflector panels 104. In addition, the differences in the sizes of the reflector panels, i.e. the central angles of the arc and the radial lengths, proves suitable for high packability wherein the 28-degree reflector panels 102 may be nested inside the 32-degree reflector panels 104.

Figure 4:
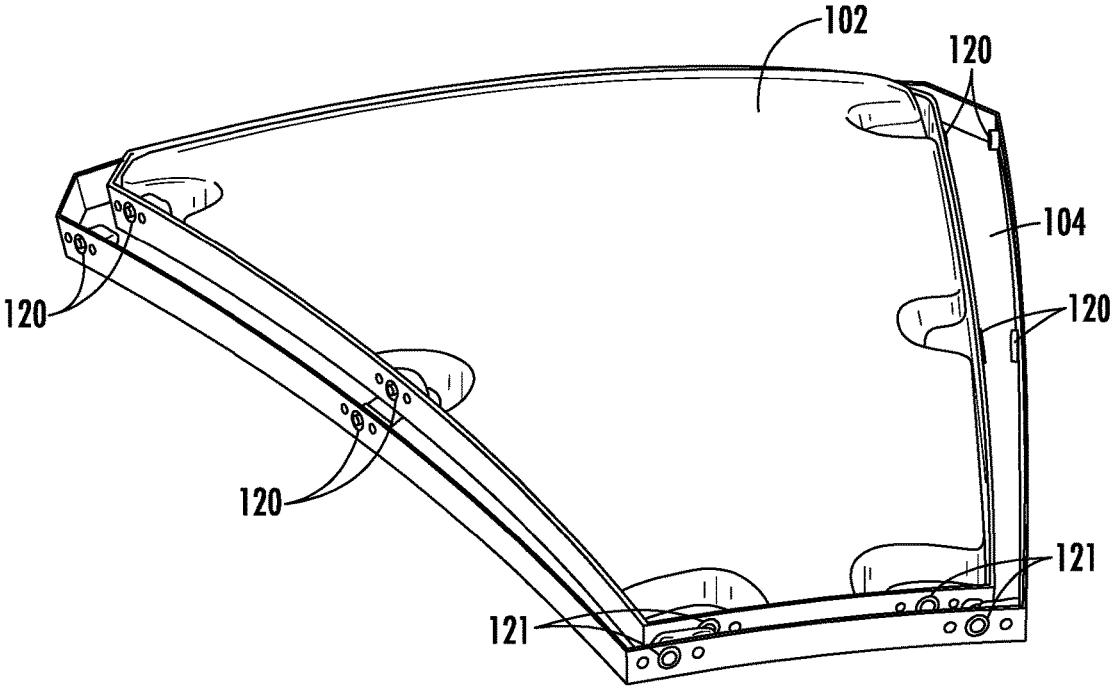
FIG. 4 illustrates a 28-degree reflector panel nested inside a 32-degree reflector panel.

FIG. 4 illustrates the 28-degree reflector panel 102 nested inside the 32-degree reflector panel 104. There are two recessed pockets on each side edge of each reflector panel 102, providing access to attachment points 120. In one embodiment, the recessed pockets are semi-circle pockets. When two adjacent reflector panels 102 and 104 are joined together, the attachment points 120 on the respective reflector panels 102 and 104 are in alignment with each other. The helical cam latching devices 10 are then used to secure two adjacent reflector panels 102 and 104 together. When reflector panels 102 and 104 and the reflector hub 110 are put together, two attachment points 121 on each of the reflector panels 102 and 104 are configured for the helical cam latching devices 10 to mount the reflector panels 102 and 104 on the reflector hub 110. There are two additional recessed pockets at both corners of the inner arc of each reflector panel 102 surrounding the corresponding attachment point 121. In one embodiment, these recessed pockets are also semi-circle pockets. Due to the different sizes of the 28-degree reflector panel 102 and the 32-degree reflector panel 104 in both chordal and radial directions, the 28-degree reflector panel 102 can be entirely nested inside the 32-degree reflector panel 104.

Figure 5:
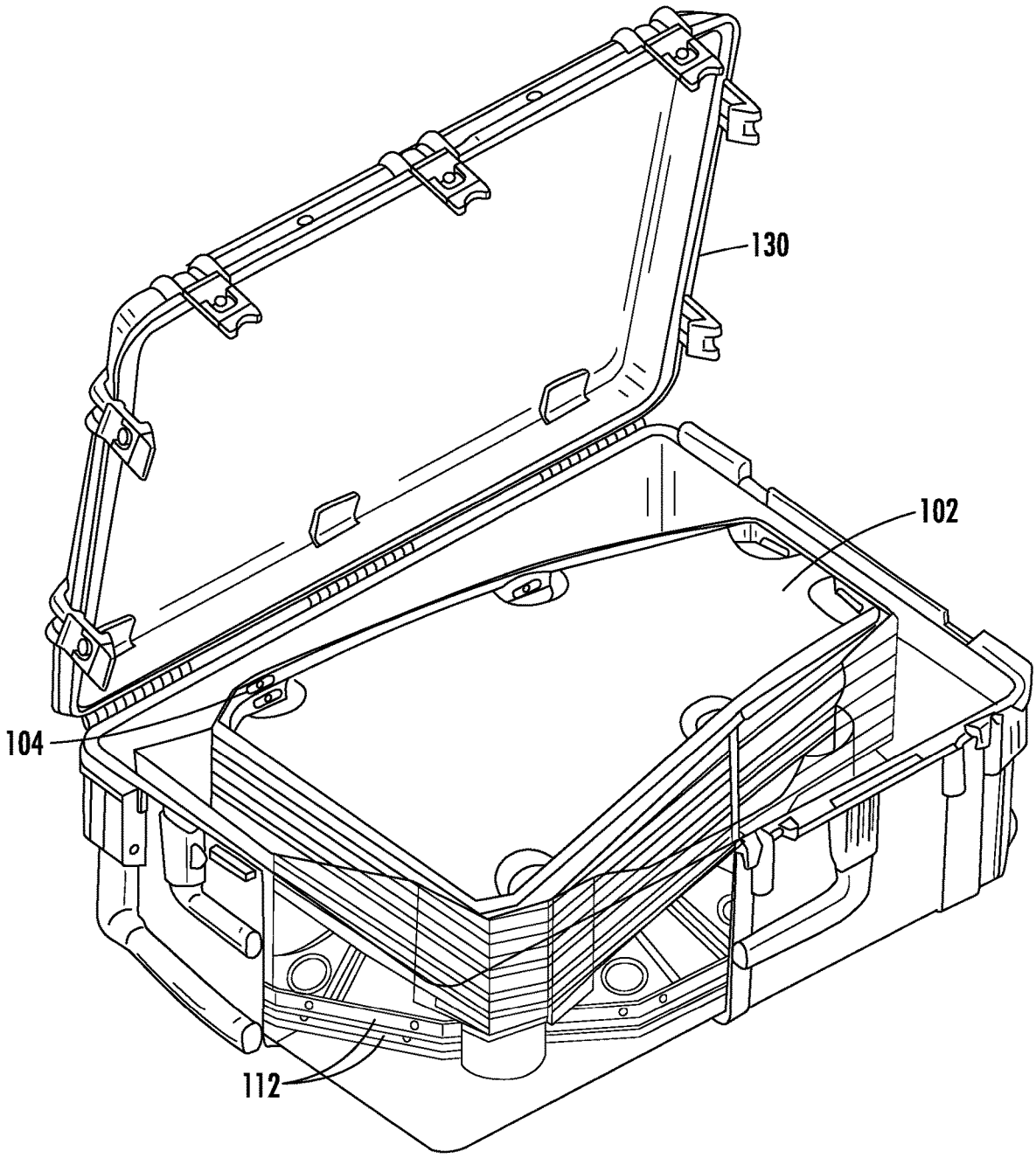
FIG. 5 illustrates a transit case for the nested reflector panels in a vertical stack.

Referring to FIG. 5, multiple pairings of nested reflector panels 102 and 104 form a well-defined vertical stack that fits efficiently and effectively in a transit case 130. In one embodiment, all reflector panels 102 and 104, two pieces of the reflector hub 110, and all required helical cam latching devices 10 are stored in the transit case 130.

Figure 6A:
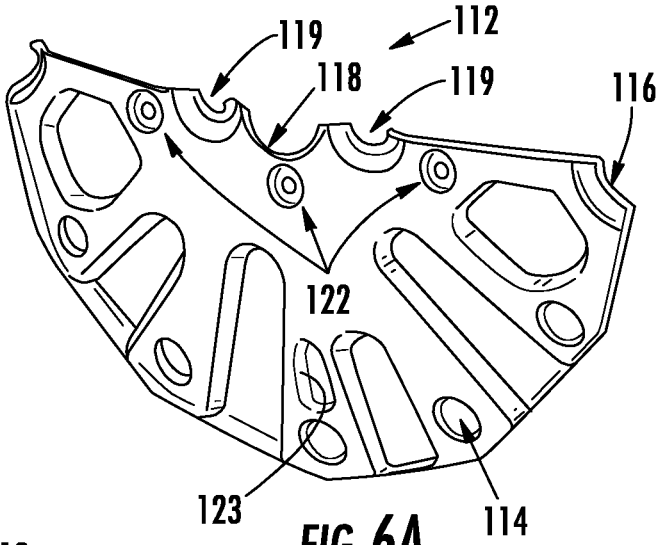
FIG. 6A illustrates a perspective view of a semi-circle piece of the reflector hub.
Figure 6B:
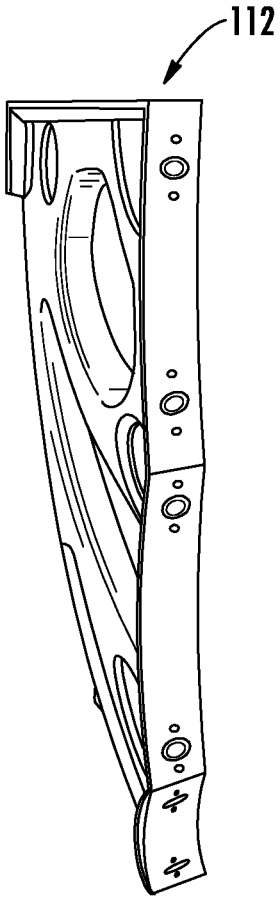
FIG. 6B illustrates a top plan view of a semi-circle piece of the reflector hub.
Figure 6C:
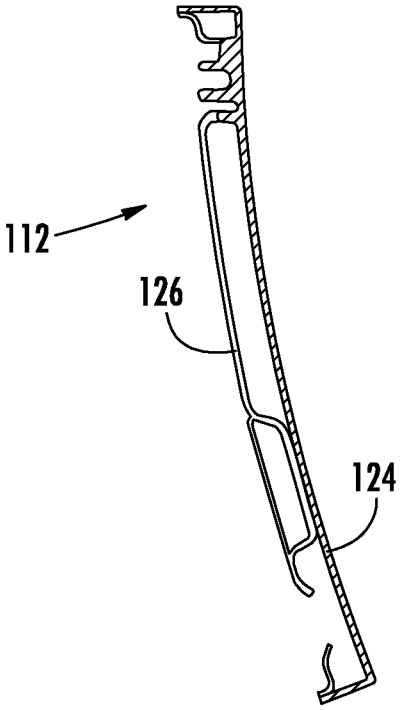
FIG. 6C illustrates a cross-sectional view of a semi-circle piece of the reflector hub.

FIGS. 6A-6C illustrate a semi-circle piece 112 which forms a portion of the reflector hub 110. As previously stated, the reflector hub 110 is formed from two semi-circle pieces 112, and the combined contour of the outer perimeter of the assembled reflector hub 110 fits the inner arc of the ring of the reflector panels 102 and 104. The semi-circle piece 112 is a hollowed carbon fiber thin-walled lightweight structure with a contoured parabolic carbon fiber reflector back structure (see below) for providing sufficient bending and torsional stiffness for operation of the reflector hub 110 in windy conditions.

Referring to FIG. 6A, the semi-circle piece 112 includes five circled recessed pockets 114 along its outer contour allowing for latch access and providing local wall reinforcement to resist loading from the mounted reflector panels 102 and 104. Two recessed semi-circular pockets 116 are located on both ends of the outer contour of the semi-circle piece 112. Along the flat end of the semi-circle piece 112, there is a recessed pocket 118 in the middle and two smaller pockets 119 on opposing sides of the recessed pocket 118. When two semi-circle pieces 112 are put together, recessed pockets are formed for the helical cam latching device 10 to bond the two semi-circle pieces 112, thereby forming the reflector hub 110. There are three additional recessed pockets 122 for assisting in mounting of the symmetric parabolic reflector 100 to the foldable positioner 300. An aluminum insert 123 provides a connection point for an elevation jack (see below) as well as a pocket for low profile storage of a spherical rod end joint.

Referring to FIGS. 6B and 6C, the top view of the semi-circle piece 112 and a cross-sectional view indicate its size, shape and the bonding structures for mounting the reflector panels 102 and 104 on the reflector hub 110. Integral hard points provide a precision mounting surface for accurately aligning the back side of the symmetric parabolic reflector 100 relative to the vertex of the parabola and ties together structurally the front skin 124 and the embossed carbon fiber back skin 126, which stiffens the overall carbon fiber structure.

Figure 7:
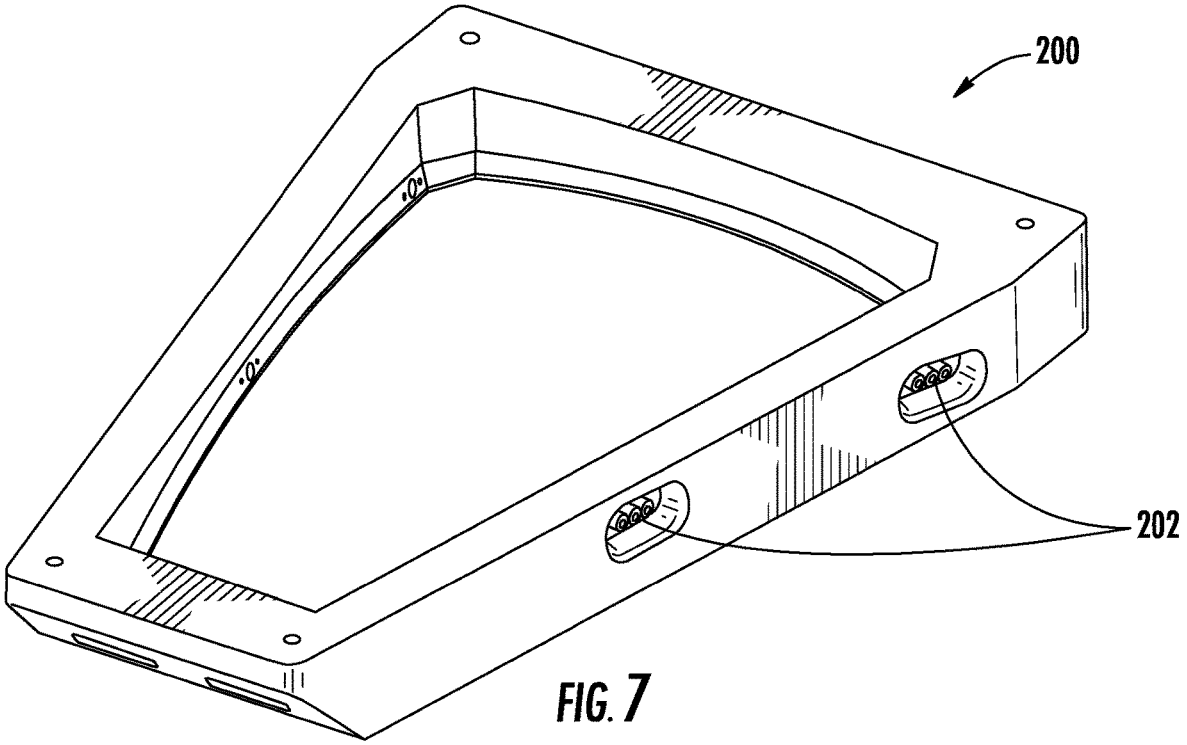
FIG. 7 is a carbon fiber layup tool for forming the reflector panels with highly repeatable mounting features.

FIG. 7 illustrates a carbon fiber layup tool 200 for forming the reflector panels 102 and 104 with highly repeatable mounting features on the sidewall regions of the reflector panels 102 and 104. In one embodiment, the carbon fiber layup tool 200 is a case enclosing a space in the shape of the reflector panel 102. In another embodiment, the carbon fiber layup tool 200 is a case enclosing a space in the shape of the reflector panel 104. Along each side of the carbon fiber layup tool 200, there are two recessed slots each containing three molding inserts 202. The manufacturing of the reflector panels 102 and 104 is a vacuum infusion process. The carbon fiber layup tool 200 provides retractable features that allow the key mounting feature to be molded into the infused carbon fiber structure and then easily retracted to allow part ejection from the carbon fiber layup tool 200. The retractable features are sealed for use with the vacuum infusion process and have a positive stop position to ensure position repeatability of the inserts that assure feature repeatability.

Figure 8:
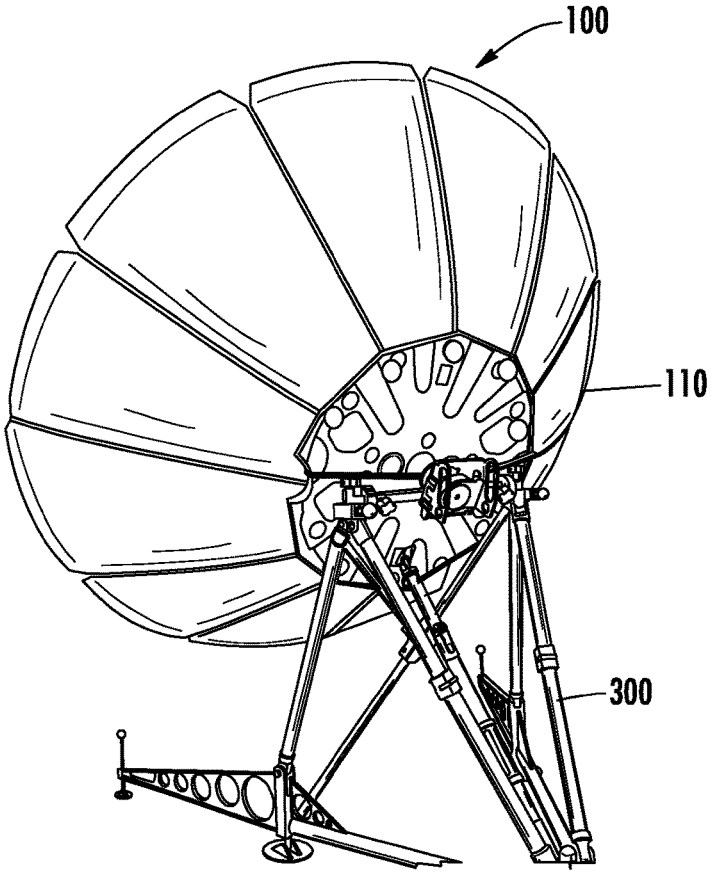
FIG. 8 is an assembled symmetric parabolic reflector supported by a positioner that is foldable.
Figure 9:
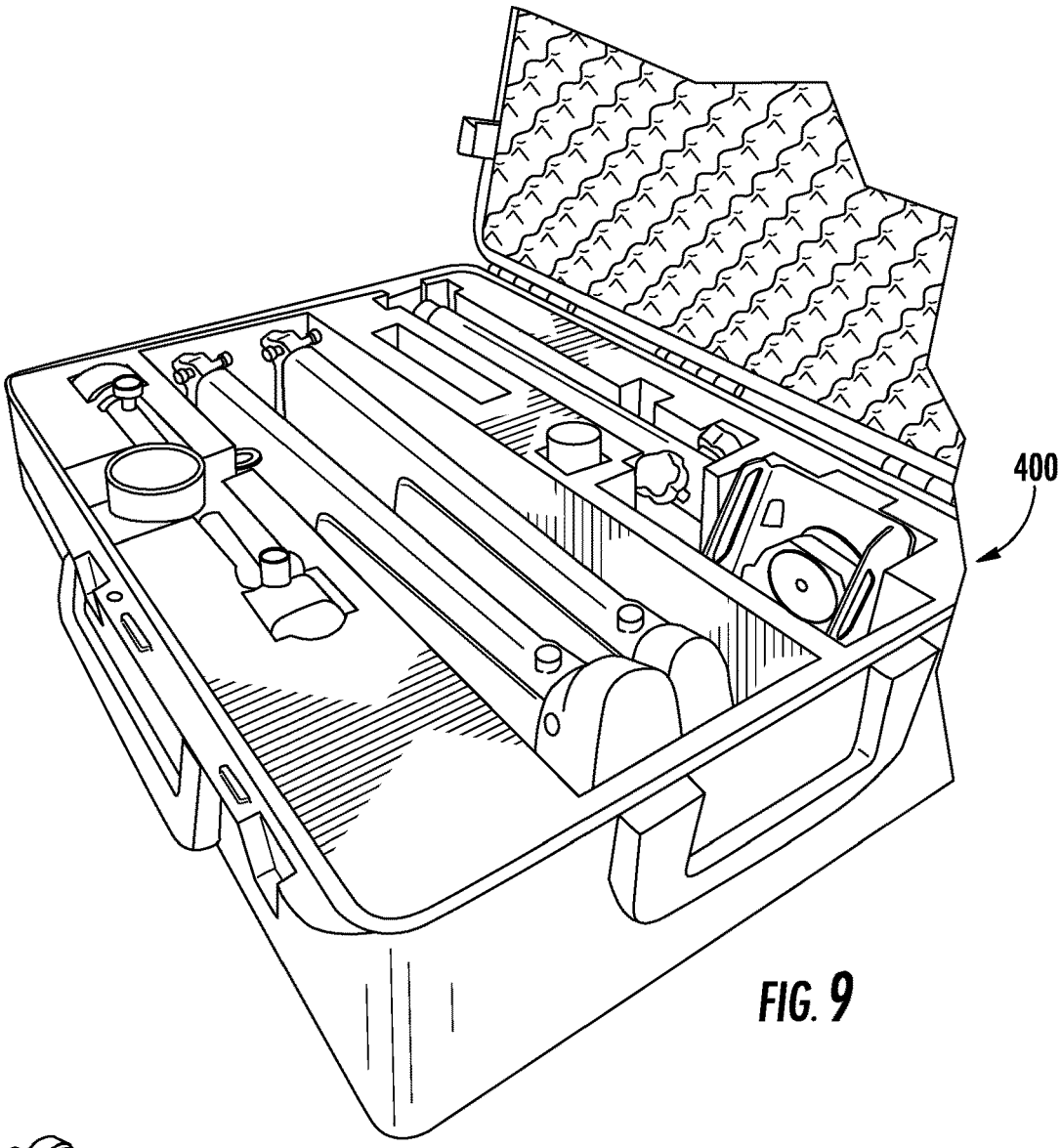
FIG. 9 is a transportation case accommodating the packed positioner.

FIG. 8 illustrates an assembled symmetric parabolic reflector 100 supported by a foldable positioner 300. The foldable positioner 300 is sturdy enough for the 2.0M antenna to operate in gusting winds. The elevation and azimuth adjustments of the foldable positioner 300 ensure the position and the orientation of the antenna for geostationary satellite acquisition and peaking. The foldable positioner 300 has a stable base that provides for leveling and serves as an anchor to avoid tipping over. Referring to FIG. 9, the foldable positioner 300 is highly packable into a relatively small transportation case 400 for storage and transportation thereof.

Figure 10:
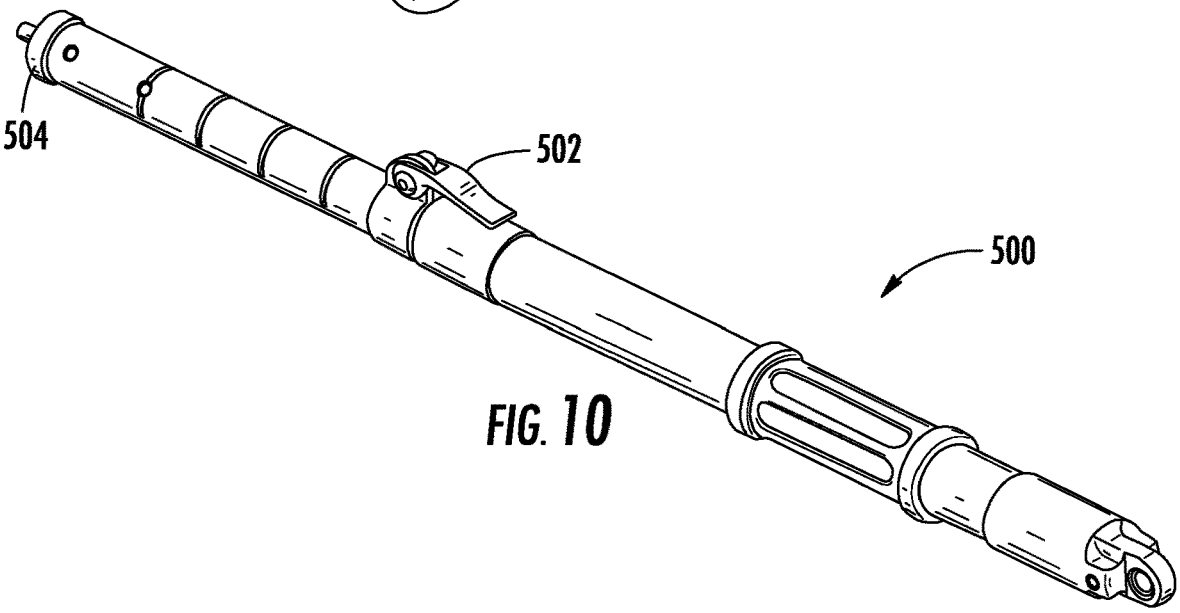
FIG. 10 is a telescoping actuator for adjustment in elevation.

FIG. 10 illustrates a telescoping manual actuator 500 for elevation adjustment. The telescoping manual actuator 500 is a lightweight stiff rod with ergonomic design. The movement of the telescoping actuator 500 is smooth enough for both coarse and fine adjustments in elevation for pointing and peaking the symmetric parabolic reflector 100 for geostationary satellite acquisition. An integral gas spring is incorporated to provide positive thrust in the telescoping actuator 500 to aid positioning in low look elevation positions. The telescoping actuator 500 includes a quick release mechanism 502 structured and disposed to permit the rod end 504 to be selectively disconnected from the reflector 100 for easy storage of the telescoping actuator 500.

Figure 11:
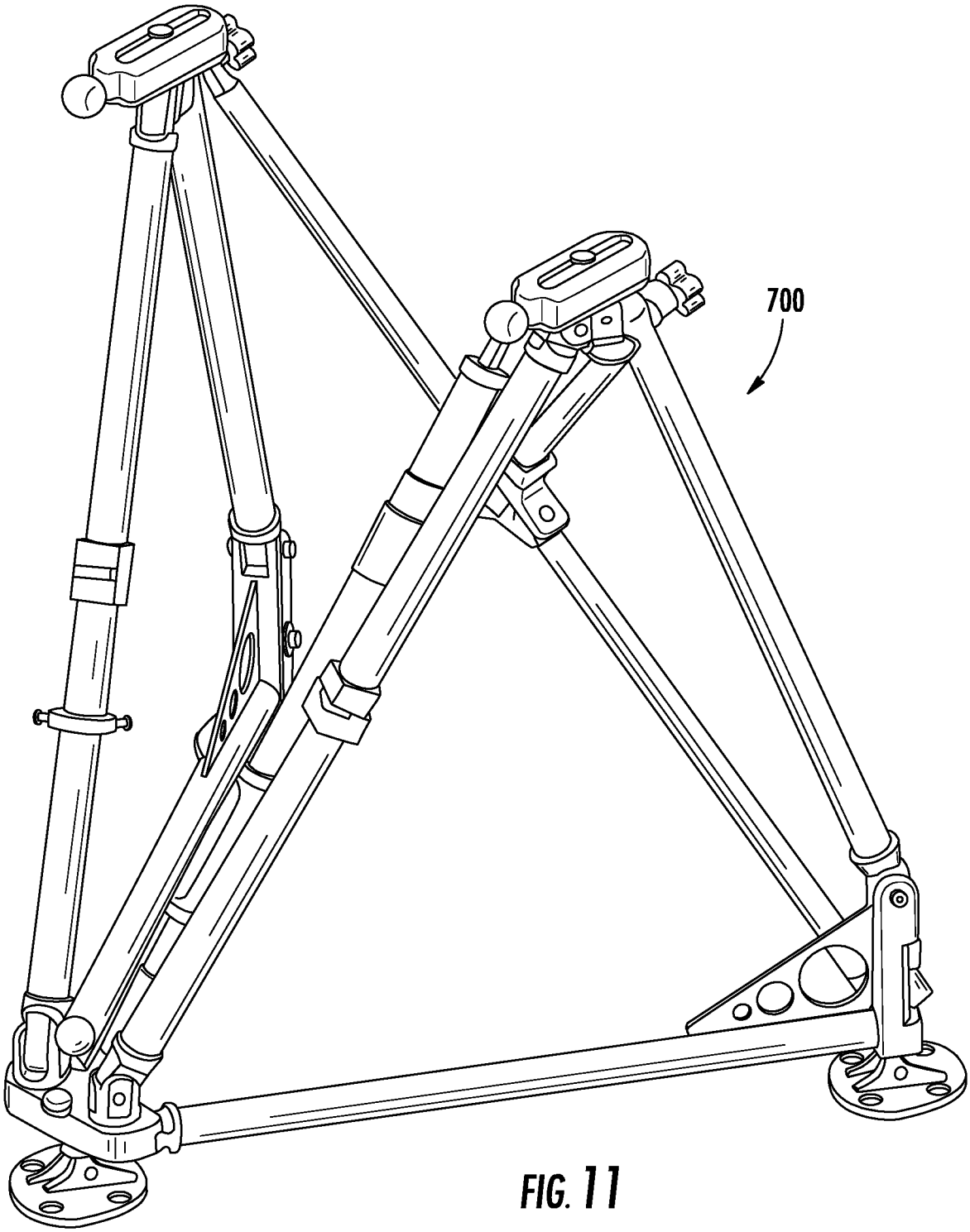
FIG. 11 illustrates a prior art design of a positioner without high-efficient packability.
Figure 12:
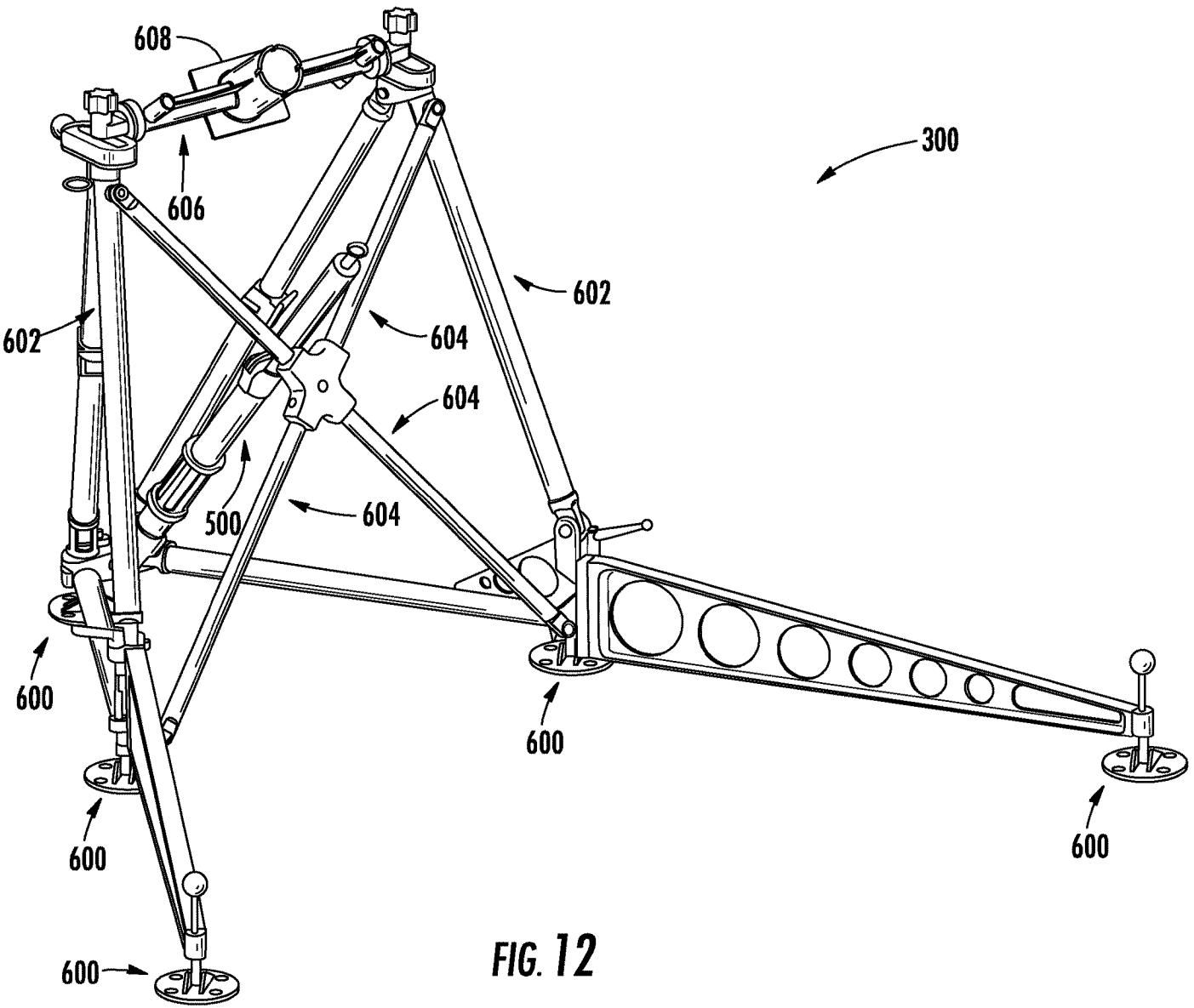
FIG. 12 illustrates a bearing-free azimuth adjustment mechanism of the foldable positioner.

Referring to FIG. 11, the traditional design of an antenna positioner 700 is generally bulky and not highly packable, thereby making transportation of the antenna positioner 700 relatively difficult. FIG. 12 illustrates the foldable positioner 300 with a bearing-free azimuth adjustment mechanism. The foldable positioner 300 includes upright tubes 602 extending from corresponding height-adjustable sand feet 600. A first end of the telescoping actuator 500 is pivotally connected to one of the height-adjustable sand feet 600 and the opposing rod end 504 of the telescoping actuator 500 connects to the hub 100 at the aluminum insert 123. The elevation-azimuth bar 606 is supported by the upright tubes 602 at opposing ends such that no bearing is used to obtain azimuth rotation. An RF package receiver plate 608 of the elevation-azimuth bar 606 is centrally secured to the reflector hub 110. The vertical motion of the elevation-azimuth bar 606 changes the angle between the upright tubes 602 of the foldable positioner 300. In such an arrangement, the telescoping actuator 500 does not have an axis of rotation, i.e. bearing-free, for geostationary acquisition. The bearing-free mechanism significantly reduces the load on the overall structure of the foldable positioner 300. Thus, the foldable positioner 300 can be designed at lower cost and lighter weight for high packability. The smooth motion of the elevation-azimuth bar 606 generates small angle changes of the upright tubes 602 of the foldable positioner 300, providing fine azimuth adjustment. The fine azimuth adjustment is up to a 20-degree azimuth adjustment by a 10-degree angular movement on both ends of the elevation axis weldment. The foldable positioner 300 also has braking and locking mechanisms to maintain the retention of its position under loads. Moreover, the components of the low-cost, lightweight, highly packable foldable positioner 300 can be selectively packed into a relatively small transportation case 400 (see FIG. 9).

From the foregoing description of various embodiments of the invention, it will be apparent that many modifications may be made therein. It is understood that these embodiments of the invention are exemplifications of the invention only and that the invention is not limited thereto.

While the present invention has been shown and described in accordance with several preferred and practical embodiments, it is recognized that departures from the instant disclosure are contemplated within the spirit and scope of the present invention.

What is claimed is:

1. A lightweight and portable space frame antenna, the antenna comprising:

a first plurality of reflector panels and a second plurality of reflector panels each being sized and configured such that each one of said first plurality of reflector panels can be nested inside a corresponding one of said second plurality of reflector panels, thereby defining a nested pairing of reflector panels;

a plurality of helical cam latching devices each being structured and disposed for joining each of the first plurality of reflector panels and each of the second plurality of reflector panels;

a reflector hub consisting of two semi-circle pieces, wherein the first plurality of reflector panels and the second plurality of reflector panels are mounted on the reflector hub to form a parabolic reflector; and a foldable positioner that is sized and configured for supporting the parabolic reflector and both elevation and azimuth adjustments; a telescoping actuator that is structured and disposed for providing elevation adjustment and may be selectively disconnected from the parabolic reflector; and an elevation-azimuth bar that is structured and disposed for providing azimuth adjustment through a bearing-free azimuth rotation.

2. The lightweight and portable space frame antenna as recited in claim 1 further comprising a first retractable layup tool that is structured and disposed for forming the first plurality of reflector panels and a second retractable layup tool that is structured and disposed for forming the second plurality of reflector panels, each through a vacuum infusion process.

3. The lightweight and portable space frame antenna as recited in claim 1 further comprising a transit case that is sized and configured for storing the plurality of nested pairings of the first and second pluralities of reflector panels on top of each other.

4. The lightweight and portable space frame antenna as recited in claim 1 further comprising a transportation case that is sized and configured for storing the foldable positioner.

5. The lightweight and portable space frame antenna as recited in claim 1 wherein each of the first plurality of reflector panels is a 28-degree panel.

6. The lightweight and portable space frame antenna as recited in claim 1 wherein each of the second plurality of reflector panels is a 32-degree panel.

7. The lightweight and portable space frame antenna as recited in claim 1 wherein the first plurality of reflector panels and the second plurality of reflector panels are joined together by the plurality of helical cam latching devices in a bi-chordal and bi-radial (BCBR) configuration.

8. The lightweight and portable space frame antenna as recited in claim 1 wherein the reflector hub has an outer contour sized and configured for selectively mounting the first plurality of reflector panels and the second plurality of reflector panels.

9. The lightweight and portable space frame antenna as recited in claim 1 wherein the telescoping actuator provides both coarse and fine elevation adjustments.

10. The lightweight and portable space frame antenna as recited in claim 1 wherein the fine azimuth adjustment is up to a 20-degree azimuth adjustment.

11. A lightweight and portable space frame antenna, the antenna comprising:

a first plurality of reflector panels and a second plurality of reflector panels each being sized and configured such that each one of said first plurality of reflector panels can be nested inside a corresponding one of said second plurality of reflector panels, thereby defining a nested pairing of reflector panels;

a plurality of helical cam latching devices each being structured and disposed for joining each of the first plurality of reflector panels and each of the second plurality of reflector panels;

a reflector hub consisting of two pieces, wherein the first plurality of reflector panels and the second plurality of reflector panels are mounted on the reflector hub in a bi-chordal and bi-radial (BCBR) configuration to form a parabolic reflector; and a foldable positioner that is sized and configured for supporting the parabolic reflector and both elevation and azimuth adjustments; a telescoping actuator that is structured and disposed for providing elevation adjustment and may be selectively disconnected from the parabolic reflector; and an elevation-azimuth bar that is structured and disposed for providing azimuth adjustment through a bearing-free azimuth rotation.

12. The lightweight and portable space frame antenna as recited in claim 11 further comprising a first retractable layup tool that is structured and disposed for forming the first plurality of reflector panels and a second retractable layup tool that is structured and disposed for forming the second plurality of reflector panels, each through a vacuum infusion process.

13. The lightweight and portable space frame antenna as recited in claim 11 further comprising a transit case that is sized and configured for storing the plurality of nested pairings of the first and second pluralities of reflector panels on top of each other.

14. The lightweight and portable space frame antenna as recited in claim 11 further comprising a transportation case that is sized and configured for storing the foldable positioner.

15. The lightweight and portable space frame antenna as recited in claim 11 wherein each of the first plurality of reflector panels is a 28-degree panel.

16. The lightweight and portable space frame antenna as recited in claim 11 wherein each of the second plurality of reflector panels is a 32-degree panel.

17. The lightweight and portable space frame antenna as recited in claim 1 wherein the telescoping actuator provides both coarse and fine elevation adjustments.

18. The lightweight and portable space frame antenna as recited in claim 1 wherein the fine azimuth adjustment is up to a 20-degree azimuth adjustment.

* * * * *